United States Patent [19]

Zollinger

[11] 4,189,153

[45] Feb. 19, 1980

[54] BOARD GAME

[76] Inventor: Werner Zollinger, 39, Bachtobelstrasse, 8045 Zurich 3, Switzerland

[21] Appl. No.: 814,881

[22] Filed: Jul. 12, 1977

[51] Int. Cl.[2] ..... A63F 3/00

[52] U.S. Cl. ..... 273/256

[58] Field of Search ..... 273/256

[56] References Cited

U.S. PATENT DOCUMENTS

| | | | |
|---|---|---|---|
| 2,026,082 | 12/1935 | Darrow | 273/256 |
| 2,088,137 | 7/1937 | McAbee | 273/256 X |
| 2,484,051 | 10/1949 | Robbins, Jr. | 273/256 |
| 2,693,961 | 11/1954 | Ripley, Jr. | 273/256 |
| 2,976,044 | 3/1961 | Corpening | 273/256 |
| 3,807,739 | 4/1974 | Henley et al. | 273/256 |
| 4,032,153 | 6/1977 | Daum | 273/256 |

*Primary Examiner*—Richard C. Pinkham
*Assistant Examiner*—R. Carl Moy
*Attorney, Agent, or Firm*—Cushman, Darby & Cushman

[57] ABSTRACT

A parlor game utilizing a game board having a first set of playing sections disposed in a continuous path around the periphery thereof, and a second set of playing sections disposed within the area defined by the first set of sections. A movable game piece is provided for each participant and die are thrown to advance the game piece around the board. Title cards are provided, one associated with each playing section of the first set, and a number of title cards capable of purchase by individual participants being associated with some of the sections of the first set of sections. A participant traverses one of at least two alternate paths in the second set of playing sections which determines his eligibility for purchase of various of the title cards associated with sections in the first set of playing sections. The sections in the first set of playing sections have first indicia, such as colors of at least two different types, the indicia being related to the at least two different paths of the interior playing sections so that the relative freedom of a participant to purchase the first playing section title cards is determined by the particular interior path traversed by that participant's game piece. Markers indicating employees, instructional cards, credit slips and lottery cards also may be provided.

13 Claims, 10 Drawing Figures

Fig.2.

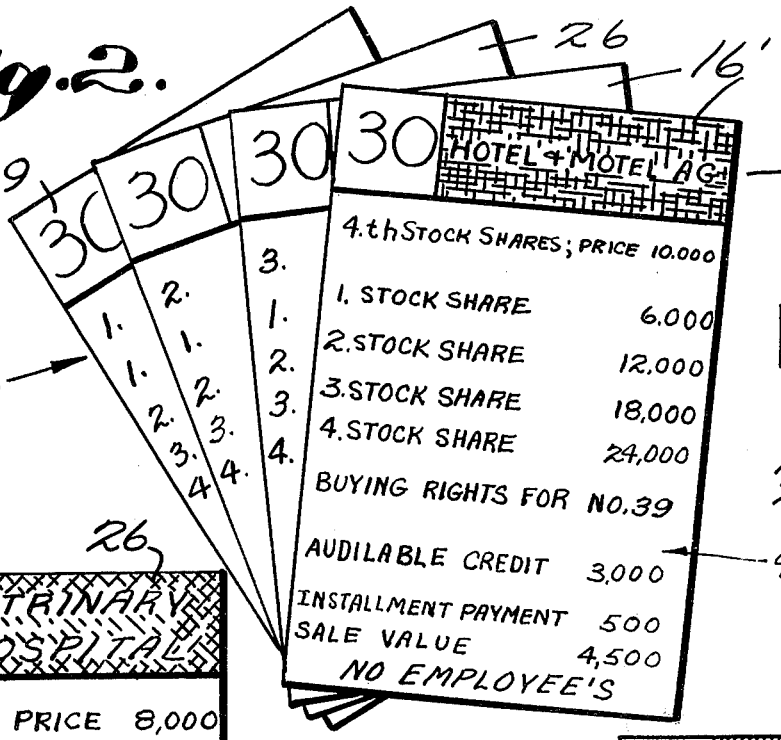

Fig.5.

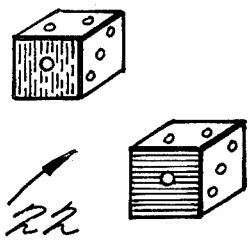

29 26

21 VETRINARY HOSPITAL

PURCHASE PRICE 8,000
COST FOR EACH EMPLOYEE 900

PAYMENTS
0 EMPLOYEES 1,800
1 " 3.200
2 " 4,800
3 " 6,400
BUYING RIGHTS FOR NO. 28
DOCTORS + DENTIST'S OFFICES
AUDILABLE CREDITS 3.000
INSTALLMENT PAYMENTS 6X500
SALE VALUE 4,500

16

26

35 ART STUDIO

PURCHASE PRICE 4,000
COST FOR EACH EMPLOYEE 400

PAYMENT 44
0 EMPLOYEES 800
1 " 44 1600
2 " 2400
3 " 42 3200
BUY RIGHTS FOR NO 34
PICTURE STUDIO
AVAILABLE CREDIT 1,000
INSTALLMENT PAYMENTS 2X500
SALE VALUE 2000

26

40 AUTO=REPAIR

PURCHASE PRICE 9,000
900

0 EMPLOYEES 1800
1 3600
2 5400
3 7200

BUY
9-GAS STATIONS
3000
6X500
4500

46

Fig.3.

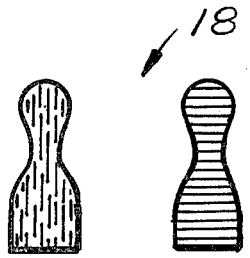

Fig.6.

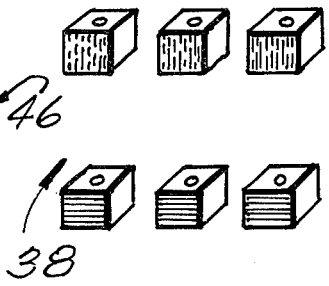

Fig. 8.
| NAME BILL | | | |
|---|---|---|---|
| CREDIT | NO. | RATE | PAID |
| 1000 | 35 | 500 | ✓ |
| | | 500 | |
40
Fig. 4.
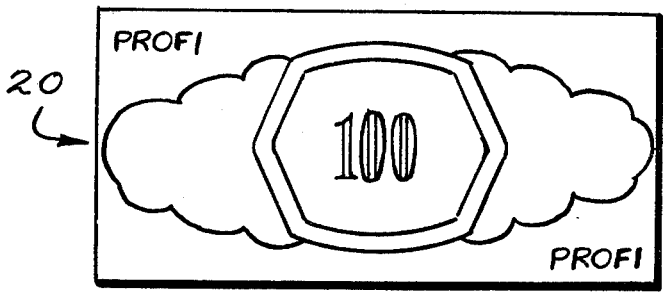
Fig. 7.
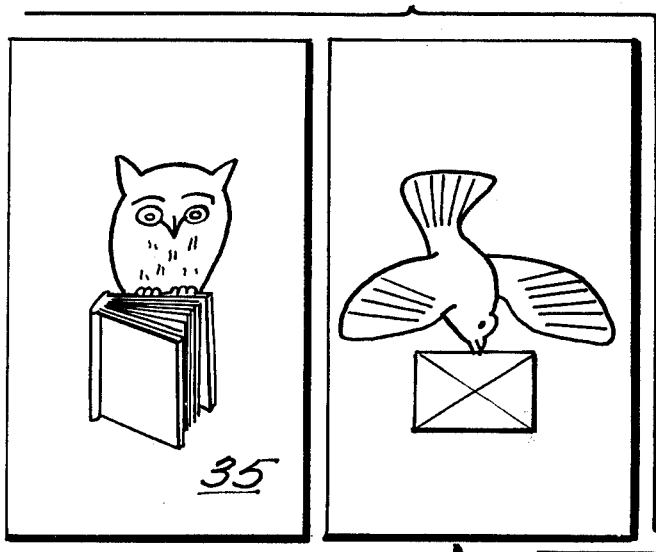
Fig. 9.
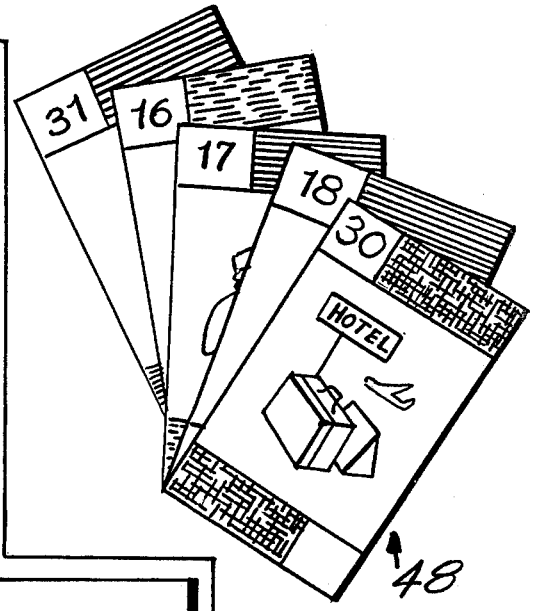
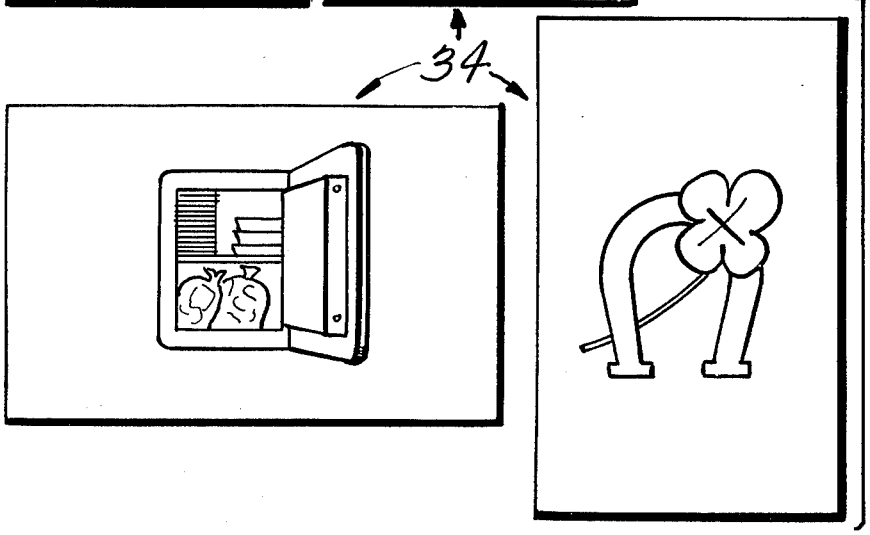

BOARD GAME

BACKGROUND AND SUMMARY OF THE INVENTION

The invention relates to a parlor game for a number of participants that seeks to combine all of the advantageous, enjoyable features of conventional parlor games, such as Monopoly (U.S. Pat. No. 2,026,082), with numerous other features adding to the variety and excitement of the game so that it generally approximates real life situations. The game according to the invention is more true to life than Monopoly since it has various educational fulfillment requirements that determine one's ability to purchase various of the game board sections. The game board sections relate to businesses as opposed to real property, and one increases the value thereof by obtaining employees for running the businesses.

Additionally, the game according to the invention provides for limited credit purchases of the businesses, reflecting the availability of credit in real life, and also provides a number of different features that add to the variety and enjoyment thereof including four different sets of instructional cards, including one set that qualifies one for further education, and option rights for the purchase of different properties besides those upon whcih a participant's game piece lands. Additionally, a number of lottery cards are provided so that the game might be enjoyed by young children, a very much simplified game utilizing the same board being provided when the lottery cards are employed.

In summary, the game according to the present invention has a frame work providing a more real nexus with modern life than many prior art games, and provides a wide variety of decisions confronting each player at each stage of the game.

It is the primary object of the present invention to provide an enjoyable parlor board game. This and other objects of the invention will become clear from an inspection of the detailed description of the invention, and from the appended claims.

BRIEF DESCRIPTION OF THE DRAWINGS

FIG. 2 is a representation of various title cards associated with playing sections on the game board of FIGS. 1*a* and 1*b;*

FIG. 3 is a perspective view of movable game pieces that may be utilized on the board of FIGS. 1*a* and 1*b;*

FIG. 4 illustrates a supply of play paper money utilizable in playing the game;

FIG. 5 is a perspective view of exemplary chance means utilizable for advancing the game pieces;

FIG. 6 is a perspective view of exemplary markers indicating an increase in the use value of sections on the game board of FIGS. 1*a* and 1*b;*

FIG. 7 is a top plan view of representative instructional cards utilizable in playing the game;

FIG. 8 is a plan view showing representative credit slips utilizable in the game; and FIG. 9 is a plan view showing representive lottery cards utilizable in a simplified version of the game.

DETAILED DESCRIPTION OF THE INVENTION

Component Parts of the Game

Figure 1A:
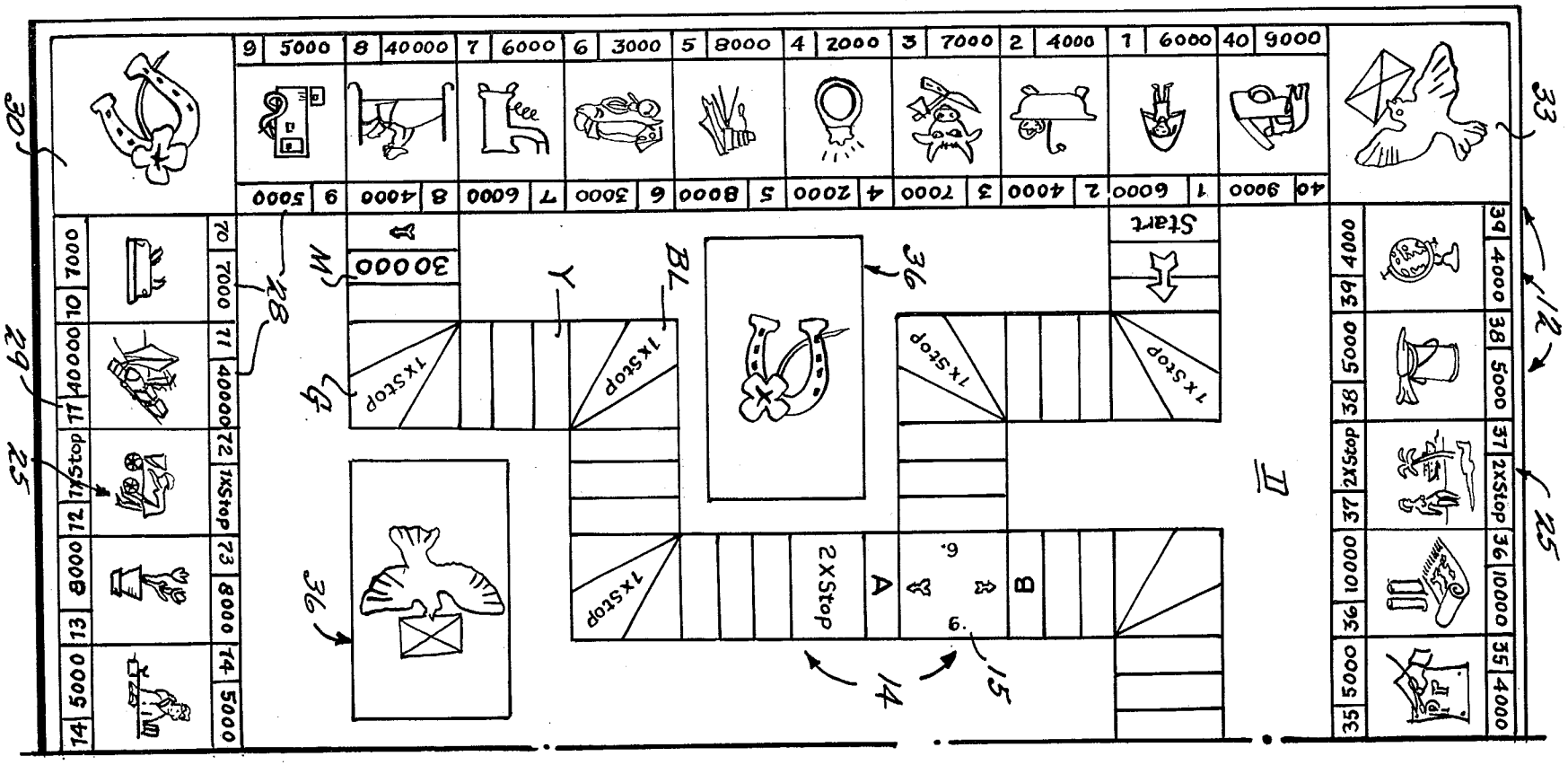
FIGS. 1*a* and 1*b* together is a top plan view of a game board utilizable in playing the game of the present invention.

The game according to the invention inlcudes a game board (see FIGS. 1*a* and 1*b*) having a first plurality of consecutive playing sections 12 disposed thereon in a continuous path, around the periphery of the board, and defining an interior area D, and a plurality of consecutive second, interior playing section 14 disposed within the interior area D. The interior playing sections 14 are disposed in at least two different paths (A, B, C), the different paths having one, crossroads, playing section 15 in common. In the board illustrated in FIG. 1, path A extends from the square "Start" to the square marked "30 000". Path B extends from the square marked "Start" to the square marked "40 000", and path C extends from the square marked "Start" to the square marked "50 000". Crossroads sections 15 are provided between paths A and B, and paths B and C respectively. plurality of title cards 16 are provided, one title card 16 being associated with each square 12 having particular indicia formed thereon, the title cards 16 indicating ownership of the business represented by a section 12. A plurality of movable game pieces 18 are provided for movement from section to section during play, indicia being associated with the game pieces fro distinguishing therebetween. A supply of paper money 20 provides a monetary standard, and chance means—such as die 22—are provided for randomly advancing the game pieces 18 around the game board, whether in the interior sections 14 or the first section 12.

At least some of the first playing section 12 have first indicia (denoted by sections 24 in FIGS. 1*a* and 1*b*) associated therewith, the first indicia including at least two different types for distinguishing between different common-type indicia groups. Preferably, the first indicia 24 includes colored section, at least two different types of first indicia 24 being provided by different colors. For the board illustrated in FIG. 1, several of the sections 12 would have indicia 24 that was yellow, while other sections 12 would have blue, green, red, or orange indicia 24. The title cards 16, as shown in FIG. 2, also have the first indicia theron; sections 26 on the title card 16 in FIG. 2 are the sections thereof having indicia corresponding to the indicia sections 24 of the playing sections 12 of FIGS. 1*a* and 1*b*. Where the indicia types are colors,the color of a section 26 of a card 16 will be the same as the color of a section 24 of the corresponding board section 12. For instance, the title cards 21, 30, 35, and 40 illustrated in FIG. 2 have the same colors (orange, yellow, red and blue respectively) as the indicia 24 of the corresponding board section 12.

While most of the playing section 12, with corresponding title cards 16, represent businesses, with only one title card 16 corresponding to a section 12, at least one (preferably four) section 12 are provided having more than one title card—16' (see FIG. 2)—associated therewith, each title card 16' for a playing section 12 having more than one title card associated therewith being capable of possession by a different participant. All of the businesses having one title card 16 associated therewith may be considered to be sole proprietorships, while the businesses having more than one title card, 16', assoicated therewith may be considered to be joint-stock companies. For the sole proprietorship the value thereof increases with a purchase of markers indicating "Employees", while for the joint-stock companies the use value thereof increases depending upon the number of shares of stock owned (represented by the individual title cards 16').

Each section 12, with the exception of the corners 30–33 (to be described more fully hereinafter) also has a numerical monetary value indicia 28 assoicated therewith (see sections 9, 10 and 11 in FIG. 1 in particular). This numerical monetary value indicia relates to the monetary standard provided by the supply of play money, and indicates the purchase price of the "business" associated with the section 12. Additionally, each section 12 (again with the exception of the corner section 30–33) has a numerical symbol 29 associated therewith, the adjacent sections being consecutively numbered with the numerical symbols 29 from one (which corresponds to the start of the interior pathway sections 14) to the desired maximum number—40 as illustrated in FIGS. 1*a* and *b*. Several of the sections 12 that have numerical symbols 29 associated therewith do not have first indicia 24 associated therewith but rather are "stop squares", so that a game piece landing on one of the squares must wait a specified number of turns before moving onwardly. Four such squares 25 are illustrated in FIGS. 1*a* and 1*b*, although any number may be provided.

Figure 1B:
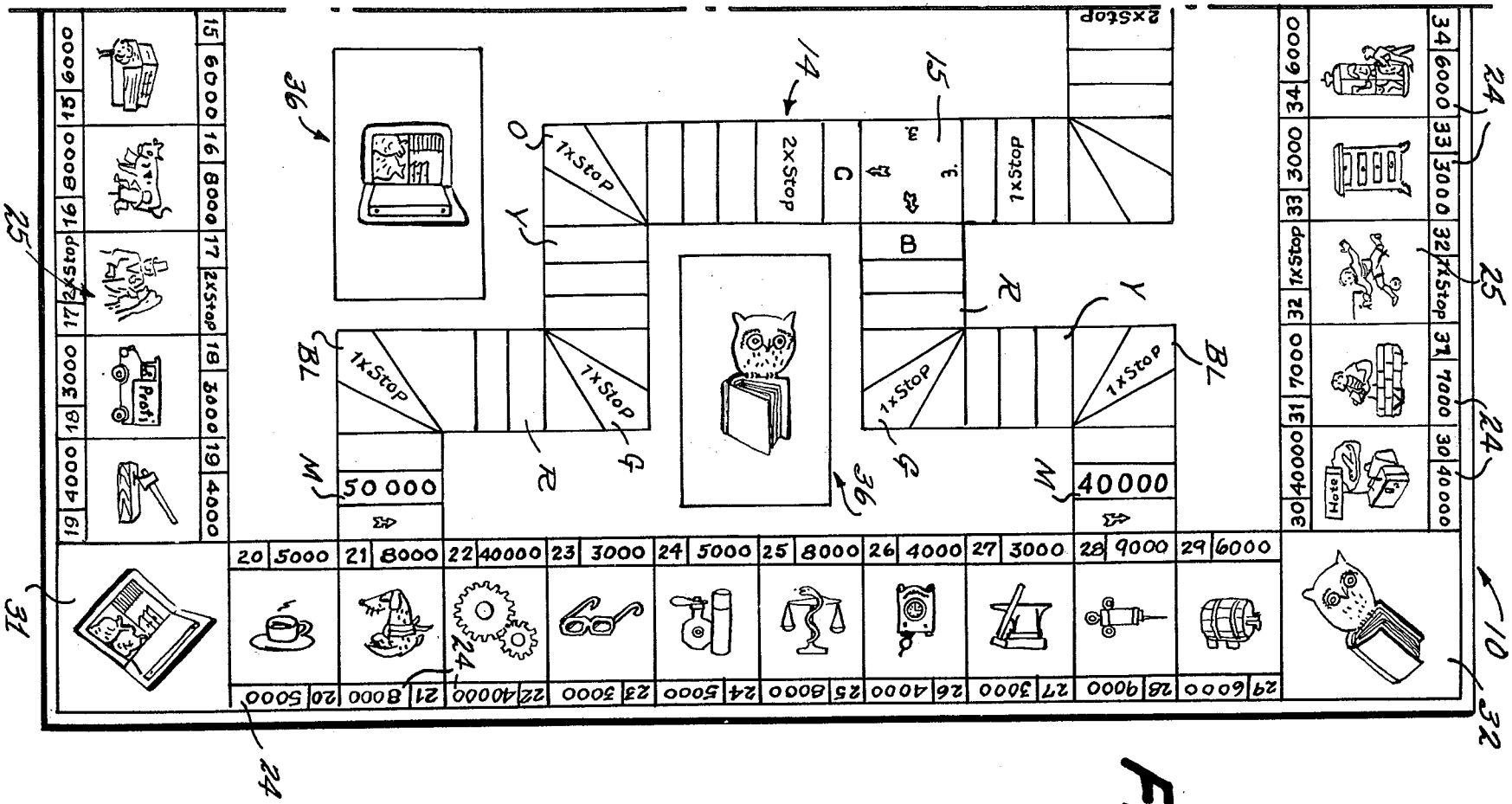

Preferably, the continuous path of first playing sections 12 is square in shape, as illustrated in FIGS. 1*a* and 1*b*, having four corner playing sections 30–33. Each corner 30–33 has fourth indicia associated therewith (picture representations in FIG. 1) instructing a participant to draw an instructional card 34 from one of a plurality of card piles. The instructional cards 34 have fourth indicia thereon (pictorial representations in FIG. 7) corresponding to the fourth indicia on the corner squares 33–33. Preferably, four different instructional card sets are provided corresponding to each corner 30–33, and sections 36 are provided in the interior area D of the game board 10 for placement of the card piles having each particular fourth indicia associated therewith.

The types of fourth indicia preferablyinclude one representing luck (squre 30), one representing a bank (square 31), one representing further education (squre 32) and one representing the Post Office (square 33). Preferably, at least some of the instructional cards corresponding to the section 32 (card 35 in FIG. 7) have printed matter thereon instructing a participant to return his game piece to one of the interior paths A through C for further education.

While the printed matter provided on the opposite sides of the cards 34 illustrated in FIG. 7 may include any desired slogan, exemplary instructions are as follows: for a luck card "You win the lottery. The bank pays you $40,000"; for a bank card: "Upon presentation of this card the bank will extend you $20,000 credit at 10 percent interest."; for a further education card (35): "You have won a $10,000 scholarship for continuing education; you may proceed to path C in the interior square."; for a post office card: "You fail to provide unemployment insuarance. Lose one employee in each business you own."

Broad sections 12 having indicia 24 of the same type (i.e. the same color) are not disposed adjacent to each other around the board, but rather are disposed randomly throughout the board. It is not necessary for the participant to have a title card 16 corresponding to more than one playing section 12 in order to purchase employee markers 38, or to receive use payments for his business. For the exemplary board illustrated in FIGS. 1*a* and 1*b* eight blue sections 12 would be provided, four orange, eight green, eight yellow, and eight red. The section having the symbol "20" could be blue, with sections "21", "22", "23" and "24" being orange, green, yellow, and red respectively.

Each interior pathway, A, B, C, preferably has end sections thereof that have indicia thereon corresponding to the indicia 24, 26 of the sections 12 with title cards 16 that may be purchased upon completion of the given pathway. For instance, pathway A (see FIGS. 1*a* and 1*b* ) could have various sections 14 thereof colored blue (BL), yellow (Y), and green (G), denoting that a person traversing pathway A can purchase title cards 16 having indicia 26 that is blue, yellow, or green. A section 14 "M" near the end of pathway A indicates the amount of money ($30,000) that a participant receives upon completion of pathway A (similar sections "M" are provided for pathways B and C). For pathway B, there would be sections 14 colored blue, yellow, and green and additionally colored red (R). For pathway C there would be sections colored green, red, blue, and yellow and additonally a section colored orange (O). Additionally, if desired, colored attachment pieces could be provided for the game pieces 18, which would be placed on the game piece 18 upon completion of a different path A, B, or C.

The markers 38 indicate employees for respective businesses on the game board 10, and are dimensioned so that they readily fit on the sections 12 (and preferably on the indicia sections 24 of the sections 12). A plurality of markers 38 may be disposed on each section 12. The markers 38 have second indicia thereon corresponding to indicia on the markers 18. Preferably, the indicia is color—for instance game pieces 18 are distinguished by different colors (i.e. blue, purple, black, etc.) and a plurality of markers 38 (for example 21 markers 38) of a given color are provided for each moveable game piece 18.

A plurality of credit slips 40 (see FIG. 8) are also provided according to the present invention. A certain available credit is associated with each business playing section 12, for the purchase thereof, and if the credit is utilized the amount of the loan is indicated on the credit slip 40 in the first column thereof, the numbe of the business (the symbol 29 associated with the business) is entered in the second column of the slip 40, the number of installment payments and the amount of each is indicated in the "Rate" column of the slip 40, and when the installment payment has been made it is checked off in the "Paid" column on the slip 40. The installment payments are due every time a participant's game piece 18 lands on or passes the "bank " square 31.

The title cards 16 (see FIG. 2) have all of the information with respect to use values, available credit, purchase price, etc. denoted thereon. For instance, for the art studio (business number 35) the purchase price is $4,000.00 the price for each employee marker 38 is $400.00 and an escalating scale 44 is provided whereby the use value increases depending upon the number of employee markers 38 disposed on a given section 12. Also, the card has a second symbol 42 thereon corresponding to the first symbol (29) of another title card 16. This indicates a purchasing right in the owner of the title card 16 of another business. For instance for title card 35, the holder also has the right to buy title card number 34. This right may be exercised at any time, except that it expires as soon as another player's game piece 18 lands on the section 12 having number 34. The next line on each card 16 indicates the avalable credit towards the purchase of the title card, and the next line indicates the number of installment payments and the amount of each payment. The final line on the card indicates the sale value of the title card should it be necessary for the participant holding the card to liquidate his assets to pay his debts.

The title cards 16' are slightly different from the cards 16 since they relate to joint-stock companies rather than sole proprietor ships. The first line thereon indicates the number of the stock certificate, and the stock's share price. The next set of lines indicates the use value to the holder, which depends upon the number of stock shares owned by the holder. The next line — line 42 — indicates the buying rights associated with that stock. The next line 46 includes the third indicia indicating the available credit toward the purchase price of a stock share.

The game also includes a number of lottery cards 48 (see FIG. 9), one card 48 corresponding to each numbered square 12 on the game board. Each lottery card 48 has the same dimensions as a section 12 on the game board, and has the first indicia (i.e. color) and first symbol 29 associated therewith as the corresponding section 12. For the game board of FIG. 1, having forty numbered sections 12, forty numbered lottery cards 48 are provided corresponding to each of the numbered sections 12 on the game board 10. The lottery cards 48 are used in a simplified version of the game.

EXAMPLARY RULES OF PLAY

While the apparatus of the game according to the present invention may be utilized with a wide variety of rule variations, a preferred set of rules—which it is believed provides a general approximation with real life situations, while providing great variety in play—is as follows:

Each player chooses a game piece 18 having second indicia thereon and selects a die 22 having the same second indica. Each participant places his piece 18 on the section 14 labeled "Start", and one participant starts off play by throwing his die 22 and advancing his piece 18 the number of sections indicated on the die. No money is passed out at the start of the game.

Each participant then completes this "education" by traversing a given pathway A, B or C of interior sections 14. A crossroads section 15 is provided at the intersection of each of the pathways A, B and B, C. As a participant's piece advances if it lands by exact count on a crossroads section 15 then the participant has the choice of continuing along either pathway associated with that crossroad section 15. For example, a participant whose game piece 18 landed on the first crossroads section 15 would have the option of going in pathway A with a fairly "quick route" to the real world with a modest monetary payment, or could continue his "education" along pathway B, with a longer path to the real world but a more substantial monetary payment upon completion, and the ability to purchase various businesses that he could not purchase merely upon the completion of pathway A. If a participant's game piece 18 does not land on a crossroads section 15 by exact count, then the participant has no choice but to continue along the pathway having the least education associated therewith (for example pathway A, when the first crossroads section 15 is reached, and pathway B when the second crossroads section 15 is reached). Indicia are provided in each pathway indicating the steps of businesses (having indicia 24) that the participant may purchase when his education is complete and he enters the real world defined by the sections 12.

Once a participant's game piece enters the sections 12 it may never return to the education sections 14 except upon the drawing of an appropriate instructional card 35 by landing on corner square 32. The game pieces 18 advance counterclockwise around the game board 10 by the utilization of the chance means 22, each player employing his chance means 22 in turn.

When a game piece 18 reaches a business section 12, landing on it by exact count, the participant can purchase the title card 16 (or 16') associated with the business if the business is not already purchased, and if the participant has a sufficient educational level to qualify for the purchase thereof (determined by comparing the indicia 24 on the particular section 12 with the indicia sections at the end of the interior pathway traversed by that participant). The numerical monetary indicia 28 on the business sections 12 indicate the purchase price for that business, and on the title card for that business the amount of available credit toward the purchase is indicated at 46. By paying the purchase price to the bank, either taking advantage of the credit arrangements or not, the participant purchases the title card 16 associated with the business, and retains the title card 16 in his possession. For instance, if a participant has traversed interior pathway A and his game piece 18 ultimately lands on numbered business 40 (the auto repair shop), he compares the indicia at the end of the pathway A with the indicia 24 on the section number 40 to see whether he is eligible to purchase that section. Since a blue square (BL) is provided toward the end of pathway A, and since the indicia 24 for the business number 40 is blue, the participant is qualified to purchase the business. The participant then pays the purchase price to the bank, either utilizing the available credit of $3,000.00 indicated at line 46 on the title card 16 associated with business number 40, or not. For instance the player could pay $6,000.00 to the bank and utilize the available credit of $3,000.00. The participant's name would then be inserted, by the banker, on the top line of a credit slip 40, $3,000.00 would be inserted in the first column on the slip 40, "40" would be inserted in the second column of the slip 40, "500" would be inserted six times on the third column of the slip 40, and each time the participant passed the banking square 31 and paid back an installment payment of $500.00 to the bank, the installment payment would be checked off in the forth column of the slip 40.

When a participant leads on a joint stock company section 12 (i.e. numbers 8, 11, 22, and 30 on the board 10 having indicia 24 that is orange, blue, green, and yellow respectively), the participant may purchase any number of stock shares associated with that section, paying the indicated purchase price for each stock share. The stock shares are given out in order, numbers 1, 2, 3, and 4 for example. Again, the participant may utilize the available credit for each stock share.

Each business purchased has "purchase rights" associated therewith indicated by indicia line 46 on each title card 16, 16' in FIG. 2. Upon purchase of the respective title card 16, 16' the participant is also entitled to purchase another business indicated by the number in line 42; this right continues until another participant's game piece 18 lands on the section for which the purchase rights exist. For instance, the purchaser of the auto repair shop also may purchase business number 9—the gas station—(see FIG. 2) at any time before another player's game piece 18 lands on the gas station section 12, and the credit available for the purchase of the title card for the business number 9 can be utilized. For the joint stock companies, the purchaser of the stock share number 1 has purchase rights for stock shares 2, 3, and 4, as well as purchase rights for the indicated other business. The purchase rights for the other stock shares expire as soon as another participant's game piece 18 lands on the joint stock company. The purchaser of share number 2 is entitled to purchase shares number 3 and 4, and again this expires once another player's game piece 18 lands on the section 12 associated with the joint stock company. For example, with reference to FIGS. 1*a*, 1*b* and 2, if a player's game piece 18 lands on business number 30, and none of the stock shares are owned, that player may purchase all four of the stock shares, and additionally may purchase business number 39, the travel service. If a player chooses to purchase stock shares 1 and 2, he pays the purchase price to the bank ($10,000.00 each), either utilizing the available credit or not, and then can continue play. His purchase rights for stock shares 3 and 4 and for business number 39 remain until another player's game piece 18 lands on the business number 30, or the business number 39 respectively. When either of these events happens, the purchase rights with respect to the respective businesses expires.

When a participant's game piece 18 lands on a business owned by another participant, the participant whose game piece landed on the business "uses" that business' services, and must make a payment to the "employer" (the owner of the title card 16 associated with the business). The payment made to the "employer" is dependent upon the number of employees that that employer has, in the case of sole proprietorships, or the number of stock certificates owned by other participant's in the case of joint stock companies. These amounts are indicated at lines 44 on the card 16, 16' respectively (see FIG. 2).

The owner of a sole proprietorship business acquires employees by the purchase of markers 38 at any time during that participant's turn. The purchase price for each employee is indicated on the second line of each title card 16 (see FIG. 2). For instance, if a participant owned the auto repair shop, business number 40, and it was his turn, he could pay $900.00 to the bank per employee, and purchase any number of markers 38 from one to three. The markers 38 which he would purchase would have the same second indicia (i.e. color) as the indicia distinguishing his game piece 18 from the other participant's game pieces. For instance, if the player who owned business number 40 had a purple game piece, and wished to purchase two employees, he would pay $1,800.00 to the bank and take two purple markers 38 from the bank and place them on the section 24 of the business number 40 on the game board. Then, if another player landed on business number 40, he would have to pay the "employer" $5,400.00. In the case of the joint stock companies, no employees are utilized. However, a participant who lands on a joint stock company must make a payment to each share holder, even if he himself is a share holder. For instance if a player owns one share of stock in the hotel (business number 30), and then his player piece lands on the hotel square, and two other participants each own one stock share in the hotel, the participant whose game piece landed on the hotel must pay $6,000.00 to each of the two other participants who own stock shares. (He may then of course purchase the outstanding, fourth stock share himself if he desires since he landed on the hotel square.)

Each time a player's game piece 18 passes the bank square 31, any outstanding installment payments must be made. If the player does not have sufficient cash to pay his installment payments (but only if he does not have sufficient cash) the participant must fire one or more employees—enough to pay the debt. The bank pays the participant $1,000.00 for each employee, no matter what the purchase price of that employee was. The same holds true when an employee lands on a business owned by another player and cannot satisfy his account. If the player still does not have enough money to satisfy his account with the bank or another player, the player can sell his shares of stock or businesses to the highest bidder. If no other participant can or wishes to but the stock or other businesses, the bank pays the participant the amount indicated on the bottom of each card (i.e. for business number 21 the bank would pay $4,000.00, and for each share of stock in the hotel or a motel, business number 30, the bank would pay $4,000.00—see FIG. 2). Should the player not be able to satisfy accounts, he must declare bankruptcy, pay his creditors to the extent possible—the other participants being paid first and then the bank—and must withdraw from the game. The game ends when only one player remains.

There are sections 12 on the game board 10 besides businesses and joint stock companies. For instance, there are a number of "rest" squares 25. When a participant's game piece 18 lands on a square 25, he remains on the square 25 for the number of turns indicated at the top of the square. For instance, when a player's game piece lands on square number 17, the player "gets married" and remains on that square for two turns. Additionally, each of the corner squares 30 through 33 has a set of "instructional cards" associated therewith. A player whose game piece lands on a corner square draws from the pile of cards corresponding to that corner square, and follows the instructions on the card. For instance, a player whose game piece landed on corner square 32 would draw a card 35 from the card pile having the picture indicia corresponding to the square 32 and would follow the instructions on the card. For instance, the card might say, "You have received a $10,000.00 scholarship from the bank. If you wish to use it move your game piece to pathway C and continue your education". The player could then immediately use the card, or hold it for future use. If the player had already traversed pathway C then he would have to return the card immediately to the deck of cards 35.

SIMPLIFIED VERSION FOR YOUNG CHILDREN

Young children often times wish to use the same game materials that their parents and older brothers and sisters use, however, young children obviously are not capable of utilizing the materials for the present game with the above version of the rules. So that young children can utilize the same game materials, the lottery cards 48 are provided. These lottery cards—one corresponding to each numbered square 12 on the game board 10—are shuffled up at the start of the game and passed out to each of the participants face down. Each participant is given one or more sides of the board (for instance squares number 10 through 19), and for each lottery card 48 that participant receives corresponding to a numbered square on his side of the board, the participant places that lottery card 48 over the corresponding square on the board. The remaining cards 48—which do not correspond to numbered sections on that participant's section of the board—are held out in the participant's hand and each player takes a turn drawing one card from another player's hand; if the card matches a square on the drawing participant's section of the board, the card 48 is placed down on the corresponding game board section, and that participant continues to draw until a card is drawn that is not on his section of the board. That card is then retained in that player's hand, and play continues until one player has covered all of the board sections 12 on his portion of the board with a card 48.

It will thus be seen that according to the present invention a game has been provided that has all of the intriguing aspects of present games, such as Monopoly, yet also has a wider variety, more closely approximates modern day life, and is educational; the game also can be played, in a different version, by younger children. While the invention has been herein shown and described what is presently conceived to be the most preferred and embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A parlor game for a number of participants comprising a game board having a first plurality of consecutive playing sections disposed threon in a continuos path, and defining an interior area, at least some of said first playing sections having at least two different types of first indicia associated therewith for distinghishing between different common-type indicia groups;

a plurality of title cards, one title card being associated with each playing section having first indicia thereon, and each title card having one of said at least two different types of said first indicia provided thereon, corresponding to the type of indicia provided on the corresponding first playing section, the first indicia related to the relative freedom of a participant to purchase each of said title cards;

at least some of said first playing sections having more than one title card associated therewith, and each title card for playing sections having more than one title card associated therewith capable of possession by a different participant;

a plurality of movable game pieces, one for each participant, for movement from section to section, second indicia being associated with said game pieces for distinguishing between said game pieces;

a plurality of consecutive second interior, playing sections disposed within said interior area, said interior playing sections being disposed in at least two different paths, said two different paths having one, cross-roads, playing section in common; and a single entrance first playing section cooperating with all said at least two different paths, and an exit first playing section cooperating with each of said at least two different paths; said first indicia of said first playing sections being related to indicia associated with each of said at least two different paths of said interior playing sections which provide that the relative freedom of a participant to purchase said first playing section title cards of given type of first indicia is determined by the particular interior path traversed by the participant's game piece;

a supply of play money providing a monetary standard;

a numerical monetary value indicia related to the monetary standard formed on at least one of each of said first playing sections having first indicia and the title cards associated therewith; and chance means for advancing the movable pieces along the interior playing sections from section-to-section, and for advancing the movable pieces around the game board continuous path from section-to-section.

2. A parlor game for a number of participants comprising a game board having a first plurality of consecutive playing sections disposed thereon in a continuous path, and defining an interior area, at least some of said first playing sections having at least two different types of first indicia associated therewith for distinguishing between different common-type indicia groups;

at least each of those sections of said first plurality of sections having first indicia has a symbol associated therewith, a different symbol being provided for each section;

a plurality of title cards, one title card being associated with each playing section having first indicia thereon, and each title card having one of said at least two different types of said first indicia provided thereon, corresponding to the type of indicia provided on the corresponding first playing section, the first indicia related to the relative freedom of a participant to purchase each of said title cards;

a plurality of movable game pieces, one for each participant, for movement from section-to-section, second indicia being associated with said game pieces for distinguishing between said game pieces;

a plurality of consecutive second interior, playing sections disposed within said interior area, said interior playing sections being disposed in at least two different paths, said two different paths having one, cross-roads, playing section in common; and a single entrance first playing section cooperating with all said at least two different paths, and an exit first playing section cooperaing with each of said at least two different paths; said first indicia of said first playing sections being related to indicia associated with each of said at least two different paths of said interior playing sections which provide that the relative freedom of a participant to purchase said first playing section title cards of given type of first indicia is determined by the particular interior path traversed by the particant's game piece;

a supply of play money providing a monetary standard;

a numerical monetary value indicia related to the monetary standard formed on at least one of each of said first playing sections having first indicia and the title cards associated therewith;

chance means for advancing the movable pieces along the interior playing sections from section-to-section, and for advancing the movable pieces around the game board continuous path from section-to-section; and a plurality of lottery cards, each card having the same first indicia type and symbol as a respective first playing section having a first indicia type and symbol, and each of said lottery cards being of the same size and shape as its respective first playing section, being adapted to be disposed over its respective first playing section.

3. A parlor game for a number of participants comprising a game board having a first plurality of consecutive playing sections disposed thereon in a continuous path, and defining an interior area, at least some of said first playing sections having at least two different types of first indicia associated therewith for distinguishing between different common-type indicia groups;

a plurality of title cards; one title card being associated with each playing section having first indicia thereon, and each title card having one of said at least two different types of said first indicia provided thereon, corresponding to the type of indicia provided on the corresponding first playing section, the first indicia related to the relative freedom of a participant to purchase each of said title cards;

at least each of those sections of said first plurality of sections having first indicia, having a primary symbol associated therewith, a different symbol for each section, and the corresponding title card to each said section also having said symbol thereon as a primary symbol, and each title card also having a secondary symbol thereon corresponding to a different one of said title cards primary symbols;

a plurality of movable game pieces, one for each participant, for movement from section-to-section, second indicia being associated with said game pieces for distinguishing between said game pieces;

a plurality of consecutive second interior, playing sections disposed within said interior area, said interior playing sections being disposed in at least two different paths, said two different paths having one, cross-roads, playing section in common; and a single entrance first playing section cooperating with all said at least two different paths, and an exit first playing section cooperating with each of said at least two different paths; said first indicia of said first playing sections being related to indicia associated with each of said at least two different paths of said interior playing sections which provide that the relative freedom of a participant to purchase said first playing section title cards of given type of first indicia is determined by the particular interior path traversed by the participant's game piece;

a supply of play money providing a monetary standard;

a numerical monetary value indicia related to the monetary standard formed on at least one of each of said first playing sections having first indicia and the title cards associated therewith; and chance means for advancing the movable pieces along the interior playing sections from section-to-section, and for advancing the movable pieces around the game board continuous path from section-to-section.

4. A game as recited in claim 1 further comprising a plurality of credit paper slips, each slip having a plurality of blank columns for the insertion of writing therein, the writing being dependent in part upon third indicia provided upon each of said title cards.

5. A game as recited in claim 1 wherein selected ones of said first playing sections, not having first indicia associated therewith, have fourth indicia associated therewith instructing a a participant to draw an instructional card from one of a plurality of card piles.

6. A game as recited in claim 5 wherein at least some of the cards in one of said plurality of instructional card piles have printed matter thereon instructing a participant to return his game piece to one of said interior paths.

7. A parlor game for a number of participants comprising a game board having a first plurality of consecutive playing sections disposed thereon in a continuous path and defining an interior area, the path being square in shape and having four corner playing sections, each corner section having a different fourth indicia associated therewith, and four piles of instructional cards being provided, one associated with each corner section; at least some of said first playing sections having at least two different types of first indicia associated therewith for distinguishing between different common-type indicia groups;

selected ones of said first playing sections, not having first indicia associated therewith, having fourth indicia associated therewith instructing a participant to draw an instructional card from one of a plurality of card piles;

a plurality of title cards, one title card being associated with each playing section having first indicia thereon, and each title card having one of said at least two different types of said first indicia provided thereon, corresponding to the type of indicia provided on the corresponding first playing section, the first indicia related to the relative freedom of a participant ot purchase each of said title cards;

a plurality of movable game pieces, one for each participant, for movement from section-to-section, second indicia being associated with said game pieces for distinguishing between said game pieces;

a plurality of consecutive second interior, playing sections disposed within said interior area, said interior playing sections being disposed in at least two different paths, said two different paths having one, cross-roads, playing section in common; and a single entrance first playing section co-operating with all said at least two different paths, and an exit first playing section cooperating with each of said at least two different paths; said first indicia of said first playing sections being related to indicia associated with each of said at least two different paths of said interior playing sections which provide that the relative freedom of a participant to purchase said first playing section title cards of given type of first indicia is determined by the particular interior path traversed by the participant's game piece;

a supply of play money providing a monetary standard;

a numerical monetary value indicia related to the monetary standard formed on at least one of each of said first playing sections having first indicia and the title cards associated therewith; and chance means for advancing the movable pieces along the interior playing sections from section-to-section, and for advancing the movable pieces around the game board continuous path from section-to-section.

8. A game as recited in claim 1 further comprising a plurality of markers, each marker being dimensioned so that a plurality of such markers may be disposed on a given first playing section, said markers having second indicia associated therewith corresponding to said game piece second indicia, a plurality of markers being provided having indicia common to the indicia of each game piece.

9. A game as recited in claim 8 wherein each title card has a set of different monetary value notations listed thereon corresponding to the number of markers that may be disposed on the playing section associated with said title card, the monetary values indicating the payment due the participant holding the title card should an opposing paticipant's game piece land on the respective first playing section while being advanced around the game board utilizing said chance means.

10. A parlor game for a number of participants, comprising (a) a game board having a first plurality of consecutive playing sections disposed thereon in a continuous path, and defining an interior area, at least one of said first playing sections having at least two different types of first indicia associated therewith for distinguishing between different common-type indicia groups;

(b) a plurality of title cards, one title card being associated with each playing section having first indicia thereon, and each title card having one of said at least two different types of said first indicia provided thereon, corresponding to the type of indicia provided on the corresponding first playing section, the first indicia related to the relative freedom of a participant to purchase each of said title cards; and at least some of said first playing sections have more than one title card associated therewith, each title card for playing sections having more than one title card associated therewith capable of possession by a different participant;

(c) plurality of moveable game pieces, one for each participant, for movement from section to section, second indicia being associated with said game pieces for distinguishing between said game pieces;

(d) a plurality of consecutive second interior, playing sections disposed within said interior area, said interior playing sections being disposed in at least two different paths, said two different paths having one, crossroads, playing section in common; and at least one section of each path cooperating with a first playing section;

(e) a supply of play money providing a monetary standard;

(f) a numerical monetary value indicia related to the monetary standard formed on at least one of each of said first playing sections having first indicia and the title cards associated therewith; and (g) chance means for advancing the moveable pieces along the interior playing sections from section-to-section, and for advancing the moveable pieces around the game board continuous path from section-to-section.

11. A parlor game for a number of participants, comprising (a) a game board hving a first plurality of consecutive playing sections disposed thereon in a continuous path, and defining an interior area, at least some of sid first playing sections having at least two different types of first indicia associated therewith for distinguishing between different common-type indicia groups;

(b) a plurality of title cards, one title card being associated with each playing section having first indicia thereon, and each title card having one of said at least two different types of said first indicia provided thereon, corresponding to the type of indicia provided on the corresponding first playing section, the first indicia related to the relative freedom of a participant to purchase each of said title cards;

(c) a plurality of moveable game pieces, one for each participant, for movement from section to section, second indicia being associated with said game pieces for distinguishing between said game pieces;

(d) a plurality of consecutive second interior, playing sections disposed within said interior area, said interior playing sections being disposed in at least two different paths, said two different paths having one, cross-roads, playing section in common; and at least one section of each path cooperating with a first playing section;

(e) a supply of play money providing a monetary standard;

(f) a numerical monetary value indicia related to the momentary standard formed on at least one of each of said first playing sections having first indicia and the title cards associated therewith;

(g) chance means for advancing the moveable pieces along the interior playing sections from section-to-section, and for advancing the moveable pieces around the game board continuous path from section-to-section;

(h) at least each of those sections of said first plurality of sections having first indicia having a symbol associated therewith, a different symbol being provided for each section; and (i) a plurality of lottery cards, each card having the same first indicia type and symbol as respective first playing section having a first indicia type and symbol, and each of said lottery cards being of the same size and shape as its respective first playing section, being adapted to be disposed over its respective first playing section.

12. A parlor game for a number of participants, comprising a game board having a first plurality of consecutive playing sections disposed thereon in a continuous path, and defiing an interior area, at least some of said first playing sections having at least two different types of first indicia associated therewith for distinguishing between different common-type indicia groups;

a plurality of title cards, one title card being associated with each playing section having first indicia thereon, and each title card having one of said at least two different types of said first indicia provided thereon, corresponding to the type of indicia provided on the corresponding first playing section, the first indicia related to the relative freedom of a participant to purchase each of said title cards;

at least each of those sections of said first plurality of sections having first indicia, having a primary symbol associated therewith, a different symbol for each section; and the corresponding title card to each said section also having said symbol thereon as a primary symbol; and each title card also having a secondary symbol thereon corresponding to a different one of said title cards primary symbols;

a plurality of moveable game pieces, one for each participant, for movement from section to section, second indicia being associated with said game pieces for distinguishing between said game pieces;

a plurality of consecutive second interior, playing sections disposed within said interior area, said interior playing sections being disposed in at least two different paths, said two different paths having one, cross-roads, playing section in common; and at least one section of each path cooperating with a first playing section;

a supply of play money providing a monetary standard;

a numerical monetary value indicia related to the monetary standard formed on at least one of each of said first playing sections having first indicia and the title cards associaed therewith; and chance means for advancing the moveable pieces along the interior playing sections from section-to-section, and for advancing the moveable pieces around the game board continuous path from section-to-section.

13. A parlor game for a number of participants, comprising a game board having a first plurality of consecutive playing sections disposed thereon in a square-shaped continuous path, having four corner sections, and defining an interior area, at least some of said first playing sections having at least two different types of first indicia associated therewith for distinguishing between different common-type indicia groups; and said four corner playing sections having a different fourth indicia associated therewith;

four piles of instructional cards, one associated with each corner playing section;

a plurality of title cards, one title card being associated with each playing section having first indicia thereon, and each title card having one of said at least two different types of said first indicia provided thereon, corresponding to the type of indicia provided on the correspnding first playing section, the first indicia related to the relative freedom of a participant to purchase each of said title cards;

a plurality of moveable game pieces, one for each participant, for movement from section to section, second indicia being associated with said game pieces for distinguishing between said game pieces;

a plurality of consecutive second interior, playing sections disposed within said interior area, said interior playing sections being disposed in at least two different paths, said two different paths having one, crossroads, playing section in common; and at least one section of each path cooperating with a first playing section;

a supply of play money providing a monetary standard;

a numerical monetary value indicia related to the monetary standard formed on at least one of each of said first playing sections having first indicia and the title cards associated therewith; and chance means for advancing the moveable pieces along the interior playing sections from section-to-section, and for advancing the moveable pieces around the game board continuous path from section-to-section.

* * * * *